US007663465B2

(12) United States Patent
Matsumoto et al.

(10) Patent No.: US 7,663,465 B2
(45) Date of Patent: Feb. 16, 2010

(54) FUSIBLE LINK UNIT

(75) Inventors: Yusuke Matsumoto, Shizuoka-ken (JP); Norio Matsumura, Shizuoka-ken (JP)

(73) Assignee: Yazaki Corporation (JP)

( * ) Notice: Subject to any disclaimer, the term of this patent is extended or adjusted under 35 U.S.C. 154(b) by 170 days.

(21) Appl. No.: 11/833,620

(22) Filed: Aug. 3, 2007

(65) Prior Publication Data

US 2008/0030295 A1 Feb. 7, 2008

(30) Foreign Application Priority Data

Aug. 4, 2006 (JP) ..... 2006-212917

(51) Int. Cl.
*H01H 85/08* (2006.01)
*H01H 85/175* (2006.01)

(52) U.S. Cl. ..... 337/187; 337/290

(58) Field of Classification Search ..... 337/187, 337/290

See application file for complete search history.

(56) References Cited

U.S. PATENT DOCUMENTS 5,346,411 A * 9/1994 Nikkinen ..... 439/620.26
5,643,693 A * 7/1997 Hill et al. ..... 429/121
5,645,448 A * 7/1997 Hill ..... 439/522
5,977,859 A * 11/1999 Kawamura et al. ..... 337/295
6,294,978 B1 * 9/2001 Endo et al. ..... 337/166
6,457,995 B1 * 10/2002 Brooks ..... 439/620.29
6,509,824 B2 * 1/2003 Inaba et al. ..... 337/295
6,512,443 B1 * 1/2003 Matsumura et al. ..... 337/189
6,520,804 B2 * 2/2003 Sumida et al. ..... 439/620.27
6,566,599 B2 * 5/2003 Sumida et al. ..... 174/50
6,580,032 B2 * 6/2003 Sumida et al. ..... 174/59
6,759,938 B2 * 7/2004 Matsumura et al. ..... 337/161
6,806,421 B2 * 10/2004 Matsumura ..... 174/50
6,824,430 B2 * 11/2004 Matsumura et al. .... 439/620.29
6,830,482 B2 * 12/2004 Matsumura et al. .... 439/620.27
7,046,115 B2 * 5/2006 Higuchi et al. ..... 337/193

(Continued)

FOREIGN PATENT DOCUMENTS

DE 199 38 068 A1 5/2000

(Continued)

OTHER PUBLICATIONS

Official Action dated Aug. 18, 2009, for co-pending German Patent Application No. 10 2007 036 646.0-34.

*Primary Examiner*—Anatoly Vortman
(74) *Attorney, Agent, or Firm*—Finnegan, Henderson, Farabow, Garrett & Dunner, L.L.P.

(57) ABSTRACT

Disclosed is a fusible link unit which is capable of being directly connected to a battery, and which includes: a band plate portion integrally formed in a bus bar; two fuse circuit-forming members contiguously formed respectively to two sides of the band plate portion; and bodies each including an electrically insulating housing formed onto a corresponding one of the fuse circuit-forming members by insert molding. Flanges as long as the entire width of the band plate portion are formed respectively in two end edges of the band plate portion by bending the flanges from the two end edges in the plate thickness direction. The bodies are arranged side-by-side with a clearance equal to the width of the band plate portion by bending the bodies along the two side edges of the band plate portion in the same direction.

20 Claims, 7 Drawing Sheets

U.S. PATENT DOCUMENTS

| | | | | |
|---|---|---|---|---|
| 7,071,808 | B2 | 7/2006 | Nakamura | |
| 7,176,780 | B2 * | 2/2007 | Iwata | 337/188 |
| 7,420,453 | B2 * | 9/2008 | Matsumura et al. | 337/295 |
| 2002/0163416 | A1 * | 11/2002 | Matsumura | 337/112 |

FOREIGN PATENT DOCUMENTS

| | | | |
|---|---|---|---|
| DE | 103 56 754 | A1 | 7/2004 |
| EP | 1 406 282 | A2 | 4/2004 |
| JP | 2000-182506 | | 6/2000 |
| JP | 2004-186006 | | 7/2004 |

* cited by examiner

PRIOR ART

FUSIBLE LINK UNIT

CROSS REFERENCE TO RELATED APPLICATION

The present application is based upon and claims the benefit of priority from Japanese Patent Application No. 2006-212917 filed on Aug. 4, 2006, the entire contents of which are incorporated herein by reference.

BACKGROUND OF THE INVENTION

1. Field of the Invention

This invention relates to a fusible link unit directly connected with a battery for vehicles without a cable.

2. Description of the Related Art

A conventional fusible link is shown in Japanese Patent Application Laid-Open Publication No. 2004-186006.

FIG. 1 shows a bus bar of the conventional fusible link disclosed in the above reference.

This fusible link comprises a flat plate-like bus bar 11 of an electrically conductive nature, and the pair of insulating housing (not shown). The bus bar 11 has fuse circuit-forming members 13A and 13B (which form large-current fuse circuit) integrally formed respectively at opposite sides of a band plate portion (bending portion) 12 formed generally at a central portion of the bus bar 11. The housings are formed integrally respectively on the pair of fuse circuit-forming members 13A, 13B by insert molding a synthetic resin. The band plate portion 12 is bent in such a manner that the pair of housings is disposed in parallel and opposed to each other, thereby forming the fusible link.

Tow pair of grooves 12*a* are formed at a generally central portion the base plate portion 12 by pressing, and extend in an upward-downward direction, the two pair of grooves 12*a* being spaced a predetermined distance from each other. The base plate portion 12 can be easily bent inwardly along the pair of grooves 12*a*. An alternator terminal portion 19 is form by bending and is located at the generally central portion of the base plate portion 12.

The fuse circuit-forming member 13A includes the elongate and narrow interconnecting plate portion 14 of a rectangular shape extending from one side edge of the band plate portion 12 at an upper end portion thereof, a plurality of screw-fastening terminal portions 16 which are connected to this interconnecting plate portion 14 in a chain-like manner through respective fuse elements (fusible portions) 15, and extend in a transverse direction, one battery terminal portion 17 which is connected directly (that is, not through the fusible portion) to one end of the interconnecting plate portion 14 remote from the band plate portion 12, and extends in the transverse direction, and fusible portion 18 (for an alternator circuit) which is formed at the other end portion of the interconnecting plate portion 14, and extends in the longitudinal direction.

The other fuse circuit-forming member 13B includes the elongate and narrow interconnecting plate portion 14 of a rectangular shape extending from the other side edge of the band plate portion 12 at the upper end portion thereof, and a plurality of screw-fastening terminal portion 16 which are connected to this interconnecting plate portion 14 in a chain-like manner through respective fuse elements 15. These fuse elements 15, 18 are blown when an electric current over a predetermined value flows therein.

The housings, which are formed integrally respectively on the pair of fuse circuit-forming members 13A, 13B by insert molding a synthetic resin, cover the whole of the fuse circuit-forming member 13A, 13B except of the band plate portion 12, fuse elements 15, 18, periphery of screw-fastening holes 16*a*, 17*a*, 17*b* of the terminal portions 16, 17.

According to the fusible link unit described above, the fuse circuit-forming members 13A, 13B are bent from both side ends in the same direction so that the fuse circuit-forming members 13A, 13B will be disposed in parallel with a predetermined distance. However, when the fuse circuit-forming members 13A, 13B are bent, the band plate portion itself comes to unexpectedly warp outwardly Consequently, distance between the fuse circuit-forming members 13A, 13B does not become constant, and then quality of the fusible link unit comes to degenerate.

According to the fusible link unit disclosed in the same references the groove 12*a* is formed by pressing on a predefined line along which the fuse circuit-forming members 13A, 13B. However, a cross section of the pressed area of the groove will decrease, and thus this decrease is disadvantage in view of a current-carrying capacity.

SUMMARY OF THE INVENTION

With the above-described conditions taken into consideration, an object of the present invention is to provide a fusible link unit which includes a bus bar capable of being adequately bent in any locations required without forming any groove along a bending line on the two sides of a band plate portion, and which can accordingly make contributions to improving the quality.

An aspect of the present invention is to provide a fusible link unit which is capable of being directly connected to a battery, and which includes a bus bar and two bodies. The bus bar includes: a band plate portion provided in a central portion of the bus bar; flanges provided respectively in two end edges of the band plate portion, the flanges being as long as an entire width of the band plate portion, and the flanges provided virtually perpendicularly to the band plate portion; and two fuse circuit-forming members consecutively installed respectively to two side ends of the band plate portion. Each of the two fuse circuit-forming members includes an interconnecting plate portion, first fuse elements connected to the interconnecting plate portion, and load connecting terminal portions connected to the interconnecting plate portion via the respective first fuse elements. Each of the two bodies has an electrically insulating housing formed on a corresponding one of the fuse circuit-forming members by insert molding. One of the two fuse circuit-forming member further includes: a second fuse element; and a battery terminal connecting portion connected to the interconnecting plate portion via the second fuse element, the battery terminal connecting portion directly connected to the battery. The band plate portion, the flanges and the two fuse circuit-forming members are integrally formed. The two fuse circuit-forming members and the two bodies are bent along the two side edges of the band plate portions in the same direction, and a flat vision of the two fuse circuit-forming members and the two bodies as well as the band plate portion forms a right square bracket. Thereby, the fuse circuit-long members are arranged side-by-side with a clearance equal to the width of the band plate portion.

The foregoing configuration makes it possible to increase the bending rigidity of the band plate portion because the two end edges of the band plate portion are provided with the respective flanges which are as long as the entire width of the band plate portion. This makes it possible to prevent the band plate portion from unnecessarily defecting outward when the fuse circuit-forming members are bent along the two side edges of the band plate portion. The preventing of the band plate portion from unnecessarily deforming makes it possible to arrange the two bodies, each configured of one of the fuse circuit-forming members and one of the housings, side-by-side with an adequate clearance interposed in between, and to thus improve the quality. Moreover, because the fuse circuit-forming members are capable of being bent in the adequate position without trouble, this makes it unnecessary to take measures such as forming grooves in the two side edges of the band plate portion for the purpose of helping to bend the fuse circuit-forming members there easily. This makes it possible to avoid a disadvantage (decrease in current-forming capacity) which would otherwise occur due to decreased cross-sections of electrically conductive channels when grooves were formed there.

In addition to the foregoing configuration each of the two fuse circuit-forming members may include: a interconnection plate portion; first fuse elements connected to the interconnecting plate portion; and load connecting terminal portions connected to the two fuse circuit-forming member via the first fuse elements, respectively. One of the two fuse circuit-forming members may further include a second fuse element; and a battery terminal connecting portion which is connected to the interconnecting plate portion with the second fuse element, and which is directly connected to the battery.

Furthermore, the fusible link unit may include covers with which exposed portions of the bus bar are covered.

Free ends respectively of the two bodies may include first and second engagement portions which engage with each other.

DETAILED DESCRIPTION OF THE EMBODIMENT

Descriptions will be provided hereinafter for an embodiment of the present invention with reference to the drawings.

A fusible link unit 70 shown in FIGS. 2 to 7 includes: a bus bar 30; resin-made housings 42A and 42B fitted respectively to expected portions in the bus bar 30 by insert molding; and resin-made covers 61 to 64 provided to cover exposed portions of the bus bar 30.

Figure 1:
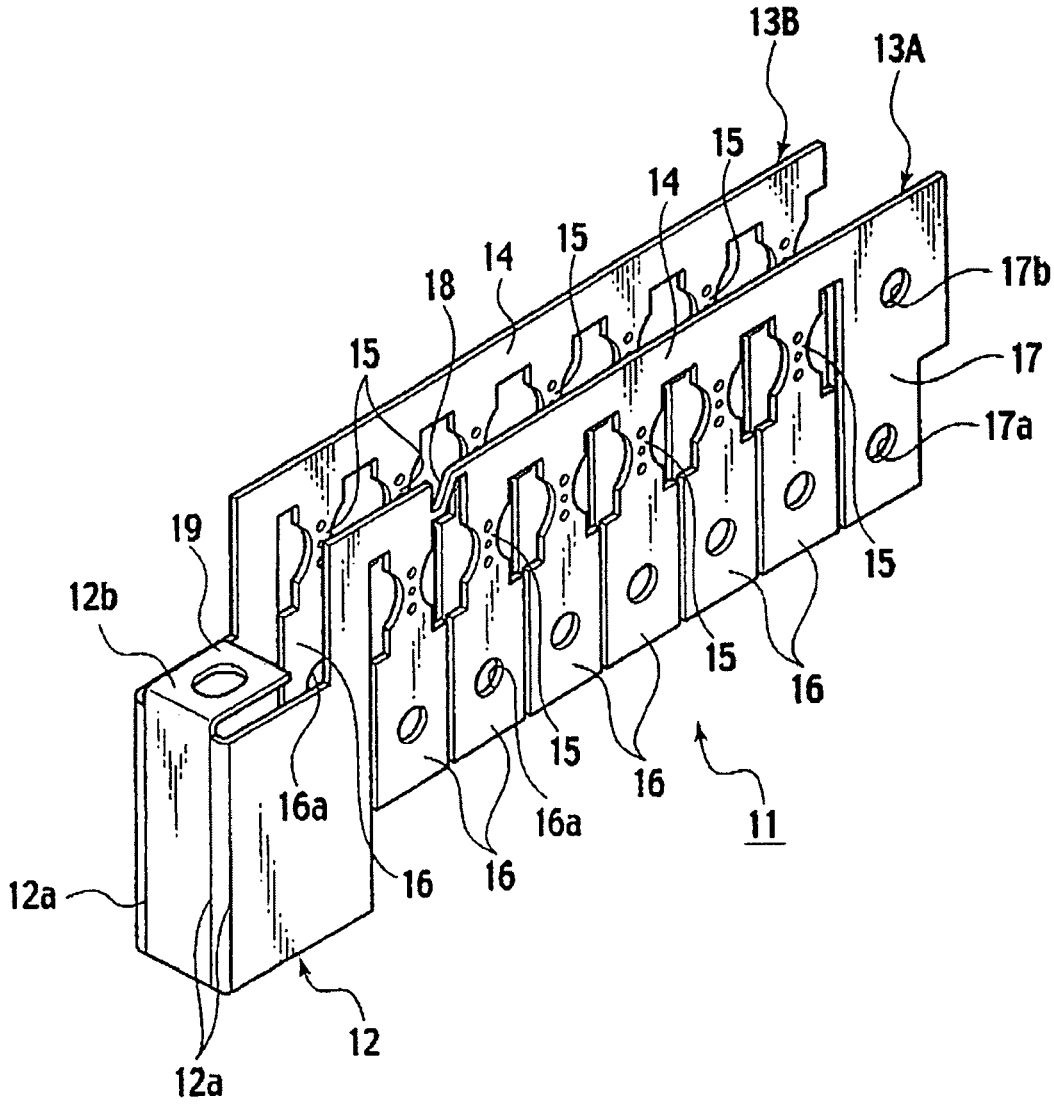
FIG. 1 is a perspective view showing a bus bar of a fusible link unit of a conventional type.
Figure 2:
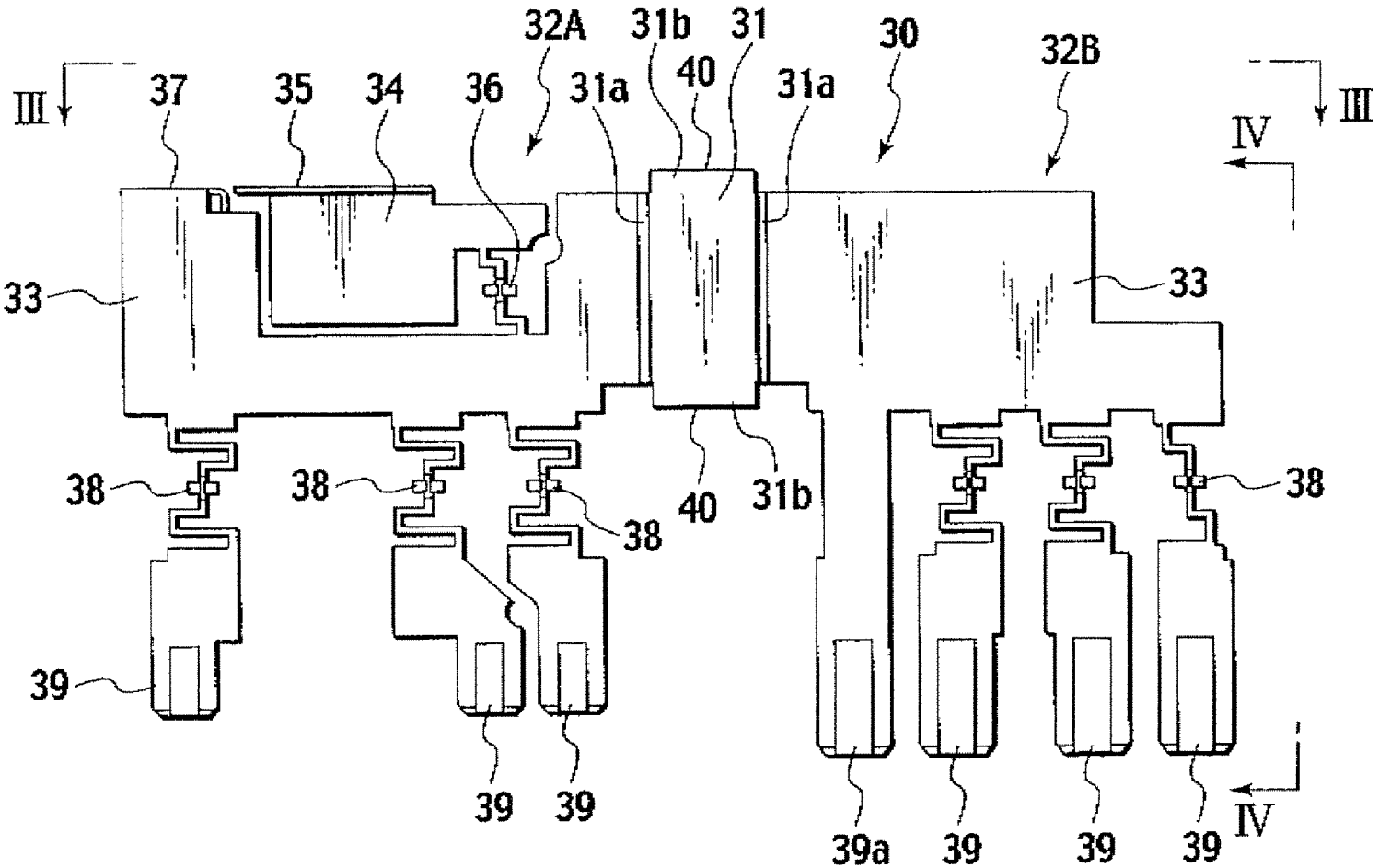
FIG. 2 is a plan view showing a configuration of a bus bar, which is a component of a fusible link unit according to an embodiment of the present invention in the process of being formed.
Figure 3:
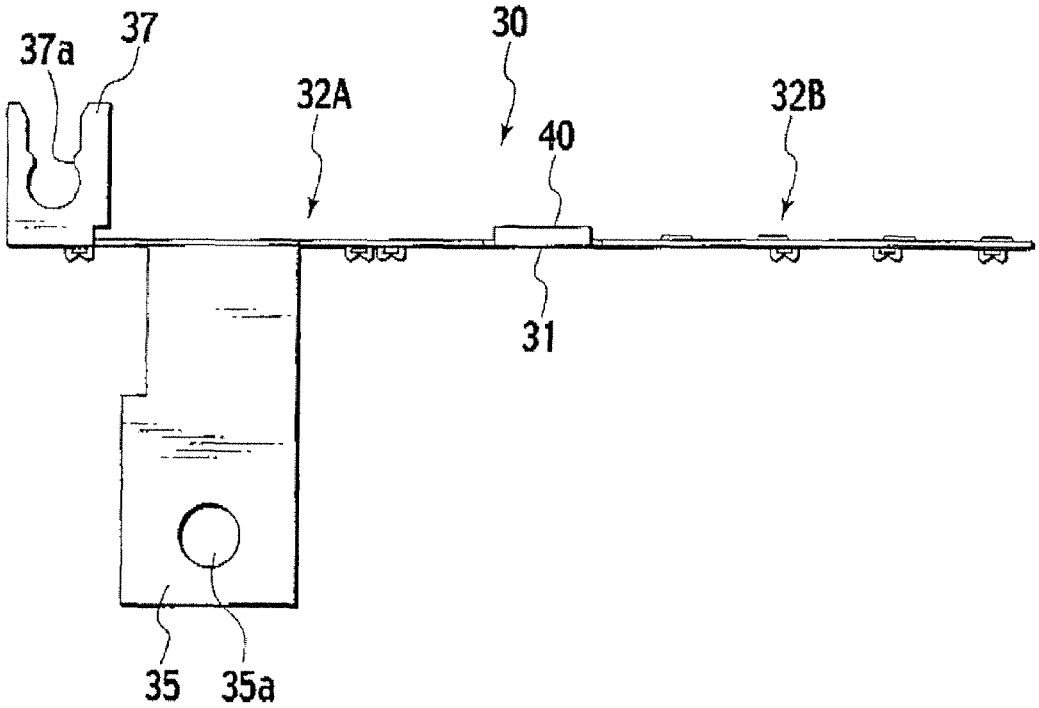
FIG. 3 is a view of the bus bar taken along the line III-III line indicated by an arrow in FIG. 2.
Figure 4:
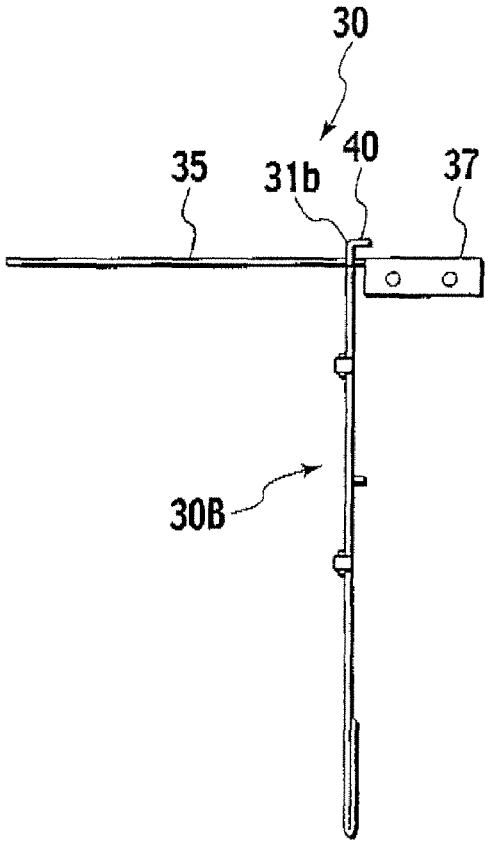
FIG. 4 is a view of the bus bar taken along the IV-IV line indicated by the other arrow in FIG. 2.

As shown in FIGS. 2 to 4, the bus bar 30 is formed by press-molding an electrically conductive plate. A band plate portion 31 and two fuse circuit-forming members 32A and 32B are integrally formed on the bus bar 30 by placing the band plate portion 31 in the center, and by forming the two fuse circuit-forming members 32A and 32B contiguously to two sides of the band plate portion 31 and bending the fuse circuit-forming members 32A and 32B along the two respective side ends 31*a* of the band plate portion 31 in the same direction while arranged side-by-side with a clearance equal to the width of the band plate portion 31.

A battery terminal connecting portion 35 and an alternator terminal connecting portion 37 are provided to the upper end of a fuse circuit-forming member 32A which is one of the two fuse circuit-forming members. The battery terminal connecting portion 35 and the alternator terminal connecting portion 37 are formed by bending the respective rectangular extended pieces at a right angle to the fuse circuit-forming member 32A but in opposite directions. The battery terminal connecting portion 35 is directly connected to a battery. The alternator terminal connecting portion 37 is connected to an alternator. A hole 35*a* through which to penetrate a bolt is provided to the battery terminal connecting portion 35 whereas a notch 37*a* through which to penetrate a bolt is provided to the alternator terminal connecting portion 37.

A interconnecting plate portion 33 and a power supply plate 34 are defined and formed in this fuse circuit forming member 32A, and the interconnecting plate portion 33 and the power supply plate 34 are connected to each other with a fuse element 36. The interconnecting plate portion 33 has the alternator terminal connecting portion 37 in the upper portion thereof his interconnecting plate portion 33 is formed while continuing from a corresponding one of the two side ends 31*a* of the band plate portion 31. The power supply plate 34 has the battery terminal connecting portion 35 in the upper portion thereof. This power supply plate 34 is separated from the band plate portion 31. In addition) the power supply plate 34 and the interconnecting plate portion 33 are connected to each other with the Use element 36 only, and the other parts of the power supply plate 34 are separated from the other parts of the interconnecting plate portion 33. Furthermore, load connecting terminal portions 39 are formed in a chain-like manner in the lower end edge of the interconnecting plate portion 33 while the load connecting terminal portions 39 are connected to the interconnecting plate portion 33 with their respective fuse elements 38.

Moreover, the other fuse circuit-forming member 32B is provided with load connecting terminal portions 39 and terminal portions 39*a* in a chain-like manner in the lower end edge of the other interconnecting plate portion 33 formed while continuing from the other side edge 31*a* of the band plate portion 31. The load connecting terminal portions 39 are connected to the lower end edge of the fuse circuit-forming member 32B with their respective fuse elements 38 whereas the terminal portion 39*a* is connected thereto with no fuse element.

Additionally, the band plate portion 31 is formed as a rectangle with a predetermined width. Flanges 40 are formed respectively in the upper and lower end edges 31*b* of the band plate portion 31 while bent in a direction of the plate thickness of the band plate portion 31. These flanges 40 are as long as the entire width of the band plate portion 31. Although the width of each of parts of the respective flanges 40 which jut out from the upper and lower end edges is small, each of the parts plays a role of a rib for increasing the bending rigidity of the band plate portion 31.

Figure 5:
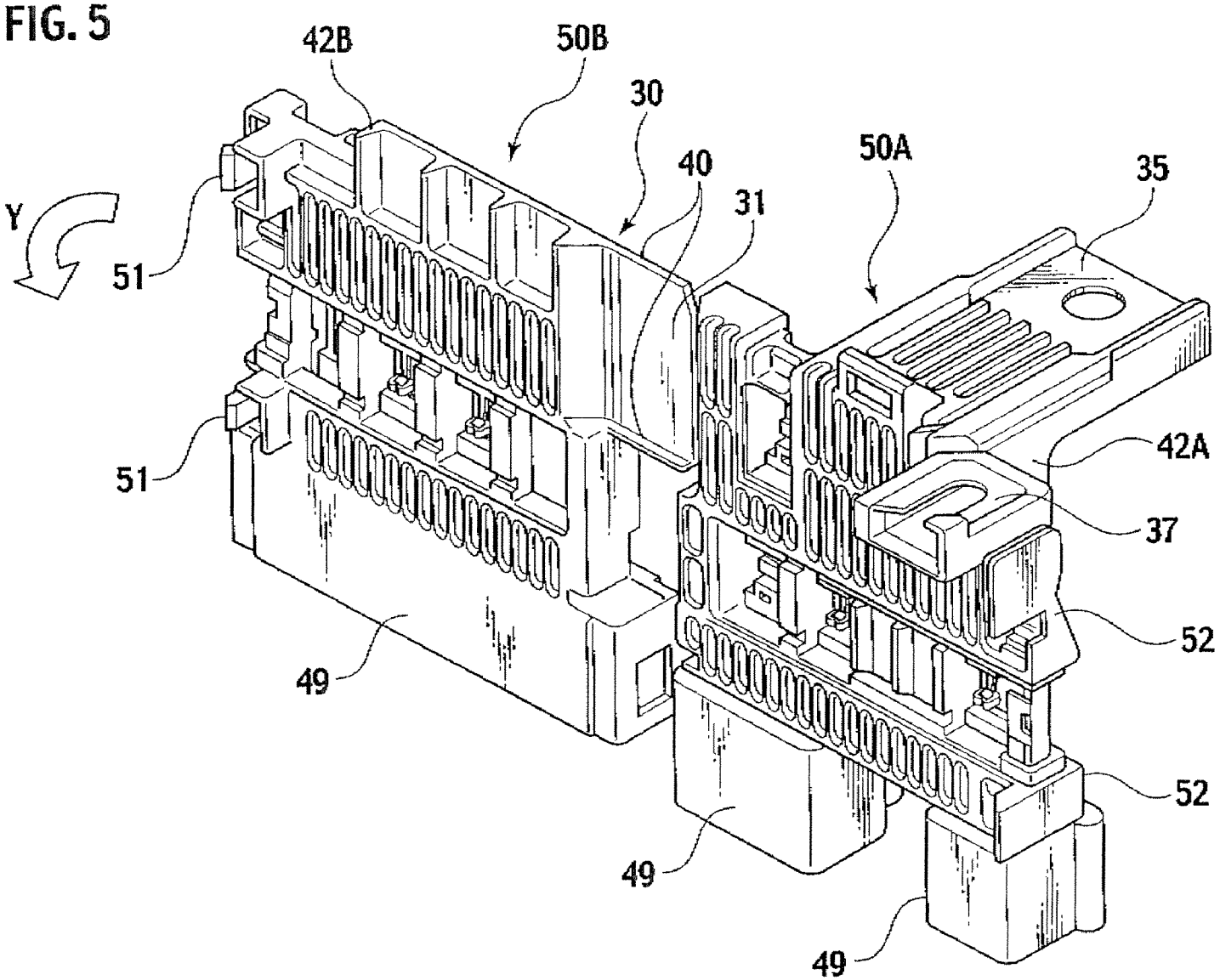
FIG. 5 is a perspective view of how resin-made housings are fitted to the bus bar shown in FIG. 2 by insert molding.
Figure 6:
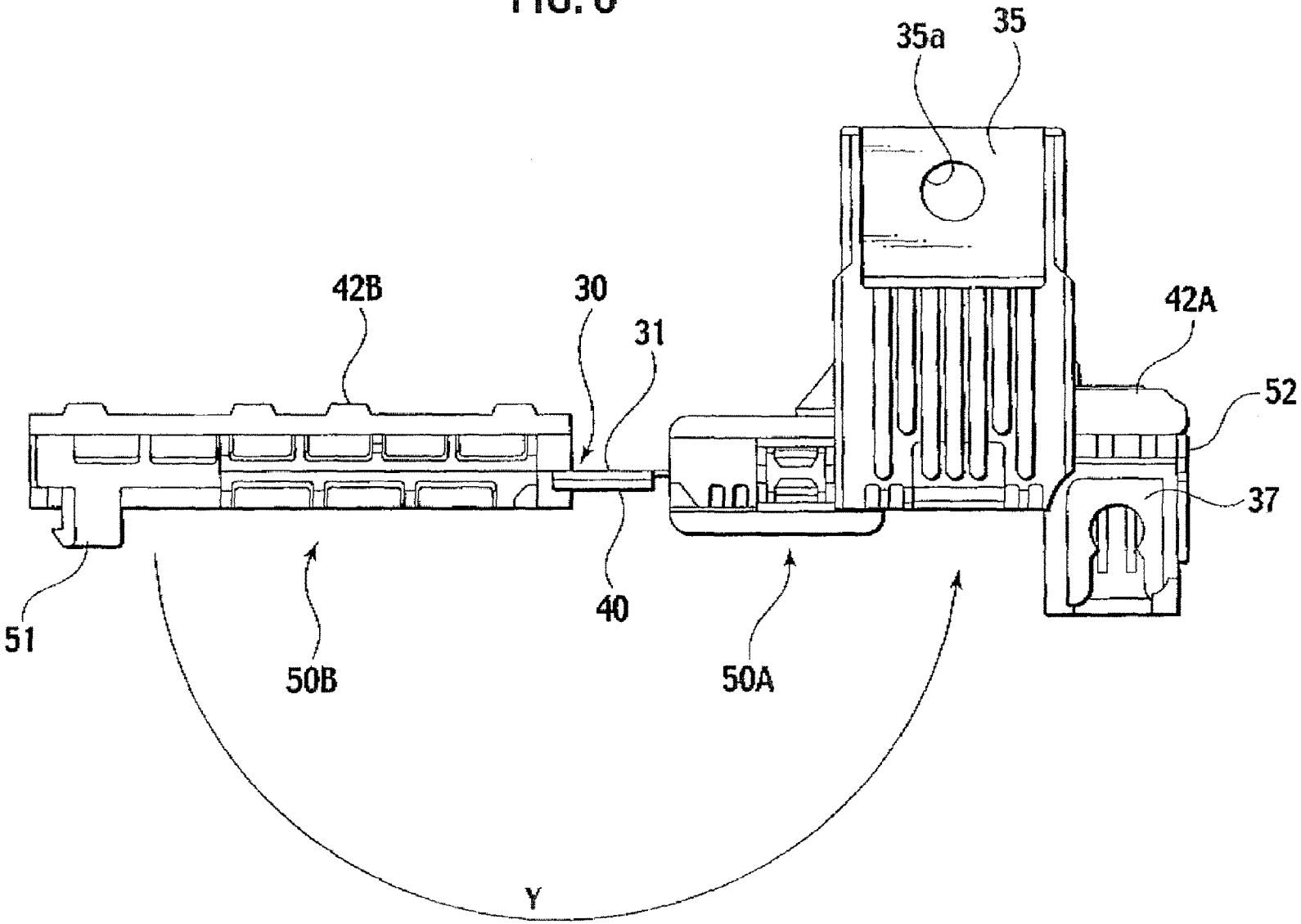
FIG. 6 shows the bus bar and the housing of FIG. 5, viewed from the above.

As shown in FIGS. 5 and 6, housings 42A and 42B each made of an electrically insulating resin are fitted respectively to the fuse circuit-forming member 32A and 32B by insert molding while required parts of each of the housings 42A and 42B are exposed to the outside. Thereby; two bodies 50A and 50B constituting the fusible link are configured of the fuse circuit-forming members 32A and 32 as well as the housings 42A and 42B, respectively. Free ends of these bodies 50A and 50B are provided respectively with second and first engagement portions 52 and 51 which engage with each other so that the engagement fixes the free ends to each other.

It should be noted that housing portions each for constituting a connector are formed respectively in the lower end portions of the housings 42A and 42B. The housing portions serve as connectors 49 capable of detachably engaging with counterpart connectors of the connectors 49 by placing the terminal portions 39 and 39*a* in the housing portions.

When this fusible link unit 70 is going to be manufactured, first of all, the band plate portion 31 is placed in a virtually central portion of a metal-made plate material in a flat plate shape. Subsequently, the bus bar 30 is formed by stamping in a way that the fuse circuits forming members 32A and 32B constituting the fuse circuits are arranged respectively on the two sides of the band plate portion 31. Thereafter, the housings 42A and 42B are respectively formed integrally onto the fuse circuit-forming members 32A and 32B by insert molding a synthetic resin. Thereby the bodies 50A and 50B are formed.

Figure 7:
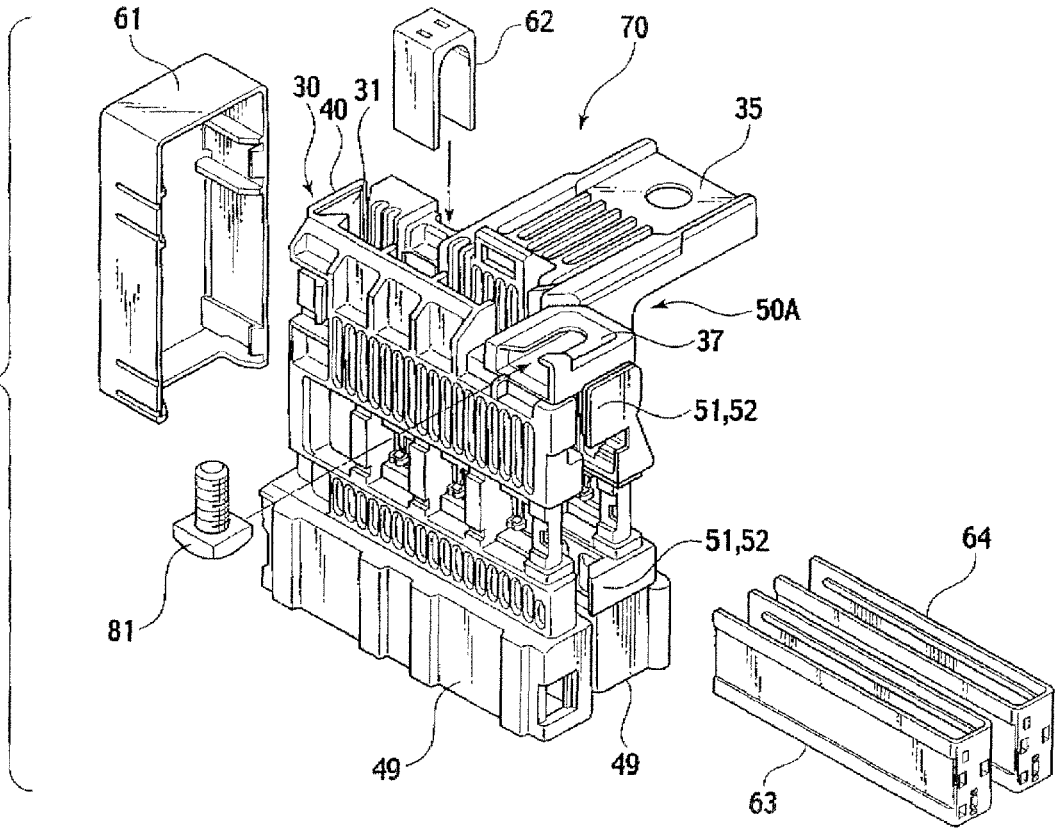
FIG. 7 is an exploded perspective view of the fusible link unit according to the present embodiment which is configured by bending parts shown in FIG. 5.
Figure 8:
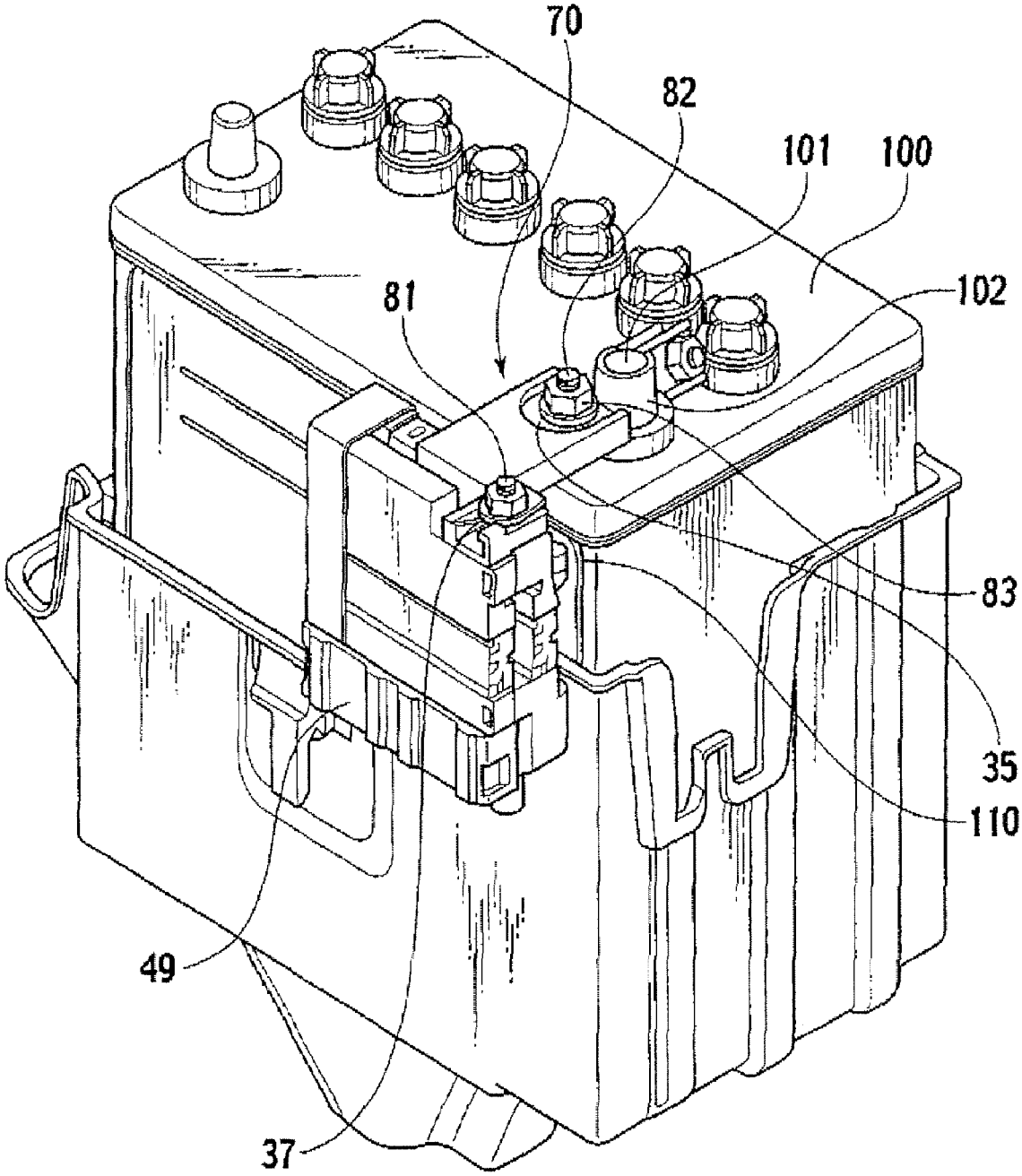
FIG. 8 is a perspective view showing how the fusible link unit according to the represent embodiment is used.

Afterward as shown in FIGS. 5 and 6, the two bodies 50A and 50B are bent respectively along the two end edges 31*a* of the band plate portion 31 in a way that a flat vision of the band plate portion 31 and the two bodies 50A and 50B forms a right square bracket while the two bodies 50A and 50B are in parallel with each other. It should be noted that the direction in which the two bodies 50A and 50B are bent is shown by an arrow Y. After that, as shown in FIG. 7, the first and second engagement portions 51 and 52 provided respectively to the free ends of the bodies 50A and 50B are locked with each other, and exposed portions of the bus bar 30 are covered with the covers 61 to 64. Thereby, the fusible link unit 70 is completed As shown in FIG. 8, in a case where this fusible link unit 70 is going to be attached to the battery, first of all, a starter cable terminal (its illustration is omitted) and a battery connecting terminal 102 are both fastened to the battery terminal connecting portion 35 by use of a bolt 82 and a nut 83. Subsequently, the battery connecting terminal 102 is connected to an electrode post 101 of the battery 100. By this, the fusible link unit 70 is directly connected to the battery 100. Thereafter, an alternator terminal 110 is fastened to the alternator terminal connection portion 37 by use of a bolt 81 and a nut. Afterward, the connectors 49 are connected to their respective counterpart connectors (their illustrations are omitted). Thereby, the wiring is completed.

These connections distributes and supplies the power, which is supplied from each of the battery 100 and the alternator, to the loads via the fuse circuits constituted by the fuse circuit-forming members 32A and 32B. If the power supplied from the battery 100 runs short, the battery 100 is charged by causing the alternator to supply the power to the battery 100. If an electrical current flows to one of the fuse elements 36 and 38 in an amount larger than a predetermined amount because of a short circuit or the like in the loads, one of the fuse elements 36 and 38 to which the larger amount of electrical current flows is heated and fused. This prevents an accident from occurring due to the overcurrent.

As described above, this fusible link unit 70 can be manufactured by the simple work of nothing but bending the two bodies 50A and 50B respectively along the two end edges 31*a* of the band plate portion 31 of the bus bar 30. This makes it possible to manufacture small-sized fusible link units 70 in large quantities with lower costs.

A single bus bar 30 makes it possible to fully secure the same number of fuse circuits as two bus bars 30 have. This makes it possible for the bus bar 30 to be laid out in a miniaturized and space-saving manner in response to an increased number of integrated circuits.

Because the two end edges 31*b* of the band plate portion 31 are provided respectively with the flanges 40 each as long as the entire width of the band plate portion 31, the bending rigidity of the band plate portion 31 is increased. For this reason, when the fuse circuit-forming member 32A and 32B are bent along the two end edges 31*a* of the band plate portion 31, the flanges make it possible to prevent the band plate portion 31 from unnecessarily deflecting outward.

The prevention of the band plate portion 31 from unnecessarily deforming makes it possible to arrange the bodies 50A and 50B, which are configured respectively of the fuse circuit-forming member 32A and 32B as well as the housings 42A and 42B, side-by-side with an, adequate clearance in between This makes it possible to enhance the quality. Because the bus bar 30 is capable of being bent along the adequate places without trouble, the fusible link unit 70 requires no groove to be formed in the two side edges of the band plate portion 31 for the purpose of facilitating the bending, unlike the fusible link unit of the conventional, type. This makes it possible to avoid a disadvantage (decrease in current-carrying capacity) which would otherwise occur due to decreased cross-sections of the electrically conductive channels when the grooves are formed.

In addition, if the electrically conductive bus bar 30 would be exposed to the outside) the bus bar 30 would be short-circuited unnecessarily However, the exposed portions of the bus bar 30 are covered with the covers 61 to 64. This coverage makes it possible to securely prevent the bus bar 30 from being unnecessarily short-circuited, and to thus improve the safety.

Furthermore, because the free ends of the bodies 50A and 50B are capable of being securely fixed to each other by locking the first engagement portion 51 and the second engagement portion 52 with each other, the rigidity of the fusible link unit 70 is capable of being increased.

The foregoing embodiment has been described citing the case where the two Use circuit-forming members 32A and 3213 are connected to the single band plate portion 31 so that the two bodies 50A and 50B are arranged in parallel. It should be noted, however, that three or more bodies are capable of being arranged in parallel by additionally arranging fuse circuit-forming members by use of band plate portions of the same type.

In this case, too, the providing of the flanges respectively to the upper and lower end edges of each of the additionally-arranged band plate portions makes it possible to prevent the band plate portions from unnecessarily deforming, and to thus improve the quality.

What is claimed is:

1. A fusible link unit capable of being directly connected to a battery, comprising:

a bus bar including:

a band plate portion provided in a central portion of the bus bar;

flanges provided respectively to two end edges of the band plate portion, the flanges being as long as an entire width of the band plate portion, and the flanges being provided virtually perpendicularly to the band plate portion; and two fuse circuit-forming members consecutively installed respectively to two side edges of the band plate portion, and two bodies including electrically insulating housings which are formed by insert molding onto the fuse circuit-forming members, respectively, wherein the band plate portion, the flanges, and the two fuse circuit-forming members are integrally formed, the two fuse circuit-forming members and the two bodies are bent along the two side edges of the band plate portion in the same directions so that a plan vision of the two fuse circuit-forming members and the two bodies with the band plate portion forms a right square bracket, and the fuse circuit-forming members are arranged side-by-side with a clearance substantially equal to the width of the band plate portion.

2. The fusible link unit according to claim 1, wherein each of the two fuse circuit-forming members includes:

an interconnecting plate portion;

first fuse elements connected to the interconnecting plate portion; and load connecting terminal portions connected to the interconnecting plate portion via the respective first fuse elements, and one of the two fuse circuit-forming members further includes:

a second fuse element; and a battery terminal connecting portion which is connected to the interconnecting plate portion via the second fuse element, and which is configured to be directly connected to a battery.

3. The fusible link unit according to claim 1, further comprising covers with which exposed portions of the bus bar are covered.

4. The fusible link unit according to claim 1, wherein free ends respectively of the two bodies are provided with first and second engagement portions which configured to engage with each other, and when the two bodies are bent, the free ends respectively of the two bodies are fixed to each other by the engagement of the first and second engagement portions with each other.

5. The fusible link unit according to claim 1, wherein the flanges are not perforated.

6. The fusible link unit according to claim 1, wherein one of the two fuse circuit-forming members includes an interconnecting plate portion and a power supply plate connected with the interconnecting plate portion via a single fuse element.

7. The fusible link unit according to claim 6, wherein the one of the two fuse circuit-forming members further includes a battery terminal connecting portion connected to the power supply plate.

8. The fusible link unit according to claim 2, wherein one of the two fuse circuit-forming members further includes a load connecting terminal portion connected directly to the interconnecting plate portion without any fuse element.

9. The fusible link unit according to claim 2, wherein the battery terminal connecting portion is not connected with the interconnecting plate portion or any of the first fuse elements except via the second fuse element.

10. The fusible link unit according to claim 2, wherein the battery terminal connecting portion is connected to the second fuse element via a power supply plate.

11. A fusible link unit, comprising:

a bus bar including:

a band plate arranged in a central portion of the bus bar, the band plate having upper and lower edges;

flanges arranged at the upper and lower edges of the band plate, the flanges spanning an entire width of the band plate and being substantially perpendicular to the band plate; and fuse circuit-forming members arranged laterally relative to the band plate, and bodies including electrically insulating housings molded onto the fuse circuit-forming members, wherein the band plate, the flanges, and the fuse circuit-forming members are integrally formed, and the fuse circuit-forming members and the bodies are bent such that the fuse circuit-forming members are arranged side-by-side with a clearance substantially equal to the width of the band plate.

12. The fusible link unit of claim 11, wherein each of the fuse circuit-forming members includes an interconnecting plate portion and first fuse elements connected to the interconnecting plate portion.

13. The fusible link unit of claim 12, wherein each of the fuse circuit-forming members further includes load connecting terminal portions connected to the interconnecting plate portion, each of the load connecting terminal portions being connected to the interconnecting plate portion via one of the first fuse elements.

14. The fusible link unit of claim 13, wherein one of the fuse circuit-forming members further includes a second fuse element and a battery terminal connecting portion connected to the interconnecting plate portion via the second fuse element.

15. The fusible link unit of claim 14, wherein the one of the fuse circuit-forming members further includes a power supply plate arranged between the battery terminal connecting portion and the second fuse element.

16. The fusible link unit of claim 15, wherein the battery terminal connecting portion is not connected with the interconnecting plate portion or any of the first fuse elements except via the second fuse element.

17. The fusible link unit of claim 13, wherein one of the fuse circuit-forming members further includes a load connecting terminal portion connected directly to the interconnecting plate portion without any fuse element.

18. The fusible link unit of claim 11, wherein the flanges are not perforated.

19. The fusible link unit of claim 11, further comprising a plurality of covers configured to cover exposed portions of the bus bar, the plurality of covers including a side cover configured to cover exposed lateral portions of the bus bar once folded and U-shaped covers configured to cover lateral and internal exposed portions of the bus bar once folded.

20. The fusible link of claim 11, wherein the bodies include free ends having first and second engagement portions configured to engage one another, so that when the bodies are bent, the free ends are fixed to one another.

* * * * *

UNITED STATES PATENT AND TRADEMARK OFFICE

CERTIFICATE OF CORRECTION

PATENT NO. : 7,663,465 B2
APPLICATION NO. : 11/833620
DATED : February 16, 2010
INVENTOR(S) : Yusuke Matsumoto et al.

It is certified that error appears in the above-identified patent and that said Letters Patent is hereby corrected as shown below:

Claim 4, col. 7, line 35, after "portions" delete "which".

Signed and Sealed this

Eleventh Day of May, 2010

David J. Kappos

David J. Kappos
*Director of the United States Patent and Trademark Office*